US008073107B2

(12) United States Patent
Bermuth et al.

(10) Patent No.: US 8,073,107 B2
(45) Date of Patent: Dec. 6, 2011

(54) BETATRON WITH A CONTRACTION AND EXPANSION COIL

(75) Inventors: Joerg Bermuth, Mainz (DE); Georg Geus, Wiesbaden (DE); Gregor Hess, Wiesbaden (DE); Urs Viehboeck, Darmstadt (DE)

(73) Assignee: Smiths Heimann GmbH, Wiesbaden (DE)

( * ) Notice: Subject to any disclaimer, the term of this patent is extended or adjusted under 35 U.S.C. 154(b) by 0 days.

(21) Appl. No.: 12/431,634

(22) Filed: Apr. 28, 2009

(65) Prior Publication Data

US 2009/0268872 A1 Oct. 29, 2009

Related U.S. Application Data

(63) Continuation of application No. PCT/EP2007/007765, filed on Sep. 6, 2007.

(30) Foreign Application Priority Data

Oct. 28, 2006 (DE) ..... 10 2006 050 953

(51) Int. Cl.
*G21G 4/06* (2006.01)
*H01J 35/14* (2006.01)
*H05H 11/00* (2006.01)

(52) U.S. Cl. ..... 378/119; 378/138; 315/504

(58) Field of Classification Search ..... 378/4–20, 378/119, 121, 138; 315/500, 501, 504
See application file for complete search history.

(56) References Cited

U.S. PATENT DOCUMENTS

| | | | | |
|---|---|---|---|---|
| 2,331,788 | A | 10/1943 | Baldwin | |
| 2,394,070 | A * | 2/1946 | Kerst | 315/504 |
| 2,572,414 | A * | 10/1951 | Wideroe | 315/504 |
| 2,663,813 | A | 12/1953 | Wideroe | |
| 2,683,804 | A | 7/1954 | Edwards et al. | |
| 2,738,421 | A | 3/1956 | Westendorp | |
| 2,803,766 | A | 8/1957 | Hebb | |
| 2,803,767 | A | 8/1957 | Baldwin | |
| 5,065,418 | A | 11/1991 | Bermbach et al. | |
| 5,319,314 | A | 6/1994 | Chen | |
| 6,201,851 | B1 * | 3/2001 | Piestrup et al. | 378/121 |
| 7,259,529 | B2 * | 8/2007 | Tanaka | 315/501 |
| 7,638,957 | B2 * | 12/2009 | Chen | 315/504 |
| 2004/0017888 | A1 * | 1/2004 | Seppi et al. | 378/57 |

FOREIGN PATENT DOCUMENTS

| | | |
|---|---|---|
| DE | 23 57 126 | 5/1975 |
| EP | 0 412 190 A1 | 2/1991 |
| GB | 709390 | 5/1954 |

* cited by examiner

*Primary Examiner* — Anastasia Midkiff
(74) *Attorney, Agent, or Firm* — Muncy, Geissler, Olds & Lowe, PLLC

(57) ABSTRACT

A betatron, especially in X-ray testing apparatus is provided, that includes a rotationally symmetrical inner yoke having two interspaced parts, an outer yoke connecting the two inner yoke parts, at least one main field coil, a toroidal betatron tube arranged between the opposing front sides of the inner yoke parts, and at least one contraction and expansion coil. An individual CE coil is respectively arranged between the front side of the inner yoke part and the betatron tube, and the radius of the CE coil is essentially the same as the nominal orbital radius of the electrons in the betatron tube.

12 Claims, 5 Drawing Sheets

BETATRON WITH A CONTRACTION AND EXPANSION COIL

This nonprovisional application is a continuation of International Application No. PCT/EP2007/007765, which was filed on Sep. 6, 2007, and which claims priority to German Patent Application No. DE 10 2006 050 953.6, which was filed in Germany on Oct. 28, 2006, and which are both herein incorporated by reference.

BACKGROUND OF THE INVENTION

1. Field of the Invention

The present invention relates to a betatron with a contraction and expansion coil, particularly for producing x-radiation in an x-ray inspection system.

2. Description of the Background Art

X-ray inspection systems such as the one illustrated in FIG. 5 are used, as is well-known, in the inspection of large-volume articles such as containers and motor vehicles for illegal contents such as weapons, explosives, or contraband goods. In so doing, x-radiation is produced and directed at the article (e.g., target 50). The x-radiation attenuated by the object is measured by means of a detector (e.g. x-ray detector 52) and analyzed by an evaluation unit (e.g., evaluation unit 54). Therefore, a conclusion can be reached on the nature of the object. This type of x-ray inspection system is known, for example, from European Pat. No. EP 0 412 190 B1, which corresponds to U.S. Pat. No. 5,065,418.

Betatrons are used to generate x-radiation with the energy needed for the inspection of more than 1 MeV. These are circular accelerators in which electrons are accelerated in a circular path. The accelerated electrons are guided onto a target, where upon impacting they produce Bremsstrahlung whose spectrum depends inter alia on the energy of the electrons.

A betatron disclosed in German Pat. Application No. DE 23 57 126 A1 includes a two-part inner yoke, in which the front sides of both inner yoke parts face each other spaced apart. A magnetic field is produced in the inner yoke by means of two main field coils. An outer yoke connects the two inner yoke part ends distant from one another and closes the magnetic ring.

An evacuated betatron tube, in which the electrons to be accelerated circulate, is arranged between the front sides of the two inner yoke parts. The front sides of the inner yoke parts are formed in such a way that the magnetic field produced by the main field coil forces the electrons into a circular path and moreover focuses them onto the plane in which the circular path lies. To control the magnetic flux, it is prior in the art to arrange a ferromagnetic insert between the front sides of the inner yoke parts within the betatron tube.

The electrons are injected, for example, by means of a electron gun into the betatron tube and the current is increased by the main field coil and thereby the strength of the magnetic field. An electric field, which accelerates the electrons in their orbit, is produced by the variable magnetic field. The Lorentz force on the electrons increases similarly simultaneously with the magnetic field strength. As a result, the electrons are held on the same orbit radius. An electron moves in an orbit when the Lorentz force directed at the center of the orbit and the opposing centripetal force cancel each other out. The Wideroe condition follows from this:

$$\frac{1}{2}\frac{d}{dt}\langle B(r_s)\rangle = \frac{d}{dt}B(r_s)$$

$$\text{with } \langle B(r_s)\rangle = \frac{1}{\pi \cdot r_S^2}\int\int_A B(r)dA.$$

In this case, $r_s$ is the nominal orbit radius of the electron, A the area defined by the nominal orbit radius $r_s$, and $\langle B(r_s)\rangle$ the magnetic field strength averaged over the area A.

The disadvantage of the prior-art betatron is the fact that, for example, because of fabrication tolerances or the scatter of the electron gun, only a small part of the electrons injected into the betatron tube focuses on the desired orbit and is thereby accelerated to the final energy. This causes a reduced efficiency. In addition, there is the problem of deflecting the accelerated electrons, therefore, to guide them from the nominal orbit to the target.

SUMMARY OF THE INVENTION

It is therefore an object of the present invention to provide a betatron that does not have the aforementioned disadvantages.

A betatron according to an embodiment of the present invention has a rotationally symmetric inner yoke of two spaced-apart parts, an outer yoke connecting the two inner yoke parts, at least one main field coil, a torus-shaped betatron tube arranged between the opposing front sides of the inner yoke parts, and at least one contraction and expansion coil (CE coil), whereby in each case precisely one CE coil is arranged between the front side of an inner yoke part and the betatron tube and the radius of the CE coil is substantially the same as the nominal orbit radius of the electrons in the betatron tube. Preferably, the betatron has in addition at least one round plate between the inner yoke parts, whereby the round plate is arranged so that its longitudinal axis coincides with the rotational symmetry axis of the inner yoke.

The CE coil is supplied with current during the injection phase, in which the electrons still do not move in the desired nominal orbit. This current flow is also called a contraction pulse. The magnetic field produced thereby changes the magnetic field between the inner yoke parts in such a way that the Wideroe condition is disturbed and a changed nominal orbit radius results intermittently. In this case, the desired nominal orbit radius is preferably between the injection radius and the changed nominal orbit radius. The electrons move on a spiral path in the direction of the changed nominal orbit radius until they are in or in the vicinity of the desired nominal orbit radius. At this time, the contraction pulse ends and the electrons are kept in the stable orbit with the desired nominal orbit radius and accelerated.

The electron gun, which injects the electrons into the betatron tube, emits the electrons in a funnel-shaped solid angle region with a specific frequency distribution. The part of this solid angle region from which the electrons are focused on the nominal orbit can be adjusted via the duration of the contraction pulse. In addition, the assembly tolerances of the electron gun can be compensated at the same time.

If the injection radius of the electrons in the betatron tube is greater than the nominal orbit radius during the acceleration, then owing to the magnetic field of the CE coil a smaller nominal orbit radius fulfills the Wideroe condition. This leads to the result that for the duration of the contraction pulse the electrons move on a path that tends toward the desired nominal orbit radius.

At the end of the acceleration process, the electrons are directed onto the target during the deflection phase. To this end, the contraction and expansion coil is again supplied with current. The current flow through the CE coil during the deflection of the electrons is also called an expansion pulse. At this time, the main field coils produce a stronger magnetic field than during the injection phase. The material of the yoke and the round plates is located in a nonlinear region of the hysteresis curve, which describes the association between the exciting magnetic flux and the magnetic flux in the material. The magnetic flux in the material is influenced differently than during the injection phase in relationship to the magnetic flux in the air between the inner yoke parts, therefore, by the contraction and expansion coil. This results in a disturbance of the Wideroe condition, which is now again fulfilled by a changed nominal orbit radius. The electrons move in a spiral path to the changed nominal orbit radius and during this movement impact the target.

If the target is, for example, outside the nominal orbit radius, the magnetic field of the CE coil thus changes the magnetic flux in such a way that a larger radius fulfills the Wideroe condition. The electrons as a result drift outward until they impact the target.

In an embodiment of the invention, the connections of a CE coil can be connected to a current or voltage source and in at least one line a switch actuatable by the control electronics is arranged between the CE coil and the current or voltage source. The switch is, for example, a high-performance semiconductor switch such as an IGBT (insulated gate bipolar transistor). Both the time point and the duration of the current flow through the coil are determined by the switch. The amplitude of the maximum coil current and thereby the maximum change in the magnetic field are adjusted by varying the duration of the contraction and/or expansion pulse. To this end, the control electronics are preferably formed in such a way that the turn-on time and the turn-on duration of the switch, therefore the beginning and duration of the contraction and expansion pulse, are variable.

According to the invention, the same contraction and expansion coil can be used both for focusing the electrons on the nominal orbit during the injection phase and for deflection of the electrons onto the target. Therefore, the space requirement is minimized in comparison with two separate coils, as a result of which better insulation of the coil wire can be used. In addition, power electronics for supplying the coil can be economized.

In an embodiment of the invention, the betatron can have a detector to determine the intensity of the generated x-radiation. The detector is preferably connected to the control electronics, so that the turn-on time and the turn-on duration of the switch can be determined by the control electronics from the output signal of the detector. A control system results that selects the contraction pulse so that the desired radiation intensity is achieved.

The opposing front sides of the inner yoke parts can be formed and arranged with mirror symmetry to one another. The symmetry plane in this regard is advantageously oriented so that the rotational symmetry axis of the inner yoke is perpendicular to it. This results in an advantageous field distribution in the air gap between the front sides by which the electrons in the betatron tube are kept in an orbit.

Furthermore, at least one main field coil can be arranged on the inner yoke, particularly on a neck or a shoulder of the inner yoke. This has the result that substantially the entire magnetic flux produced by the main field coil is guided through the inner yoke. In an advantageous manner, the betatron has two main field coils, a main field coil being arranged on each of the inner yoke parts. This leads to an advantageous distribution of the magnetic flux on the inner yoke parts.

The betatron of the invention is advantageously used in an x-ray inspection system for security inspection of objects. Electrons are injected into the betatron and accelerated, before they are guided to a target having, for example, tantalum. There, the electrons produce x-radiation with a known spectrum. The x-radiation is directed onto the object, preferably a container and/or a motor vehicle, and there modified, for example, by scattering or transmission attenuation. The modified x-radiation is measured by an x-ray detector and analyzed by means of an evaluation unit. A conclusion on the nature or the content of the object can be reached from the result.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
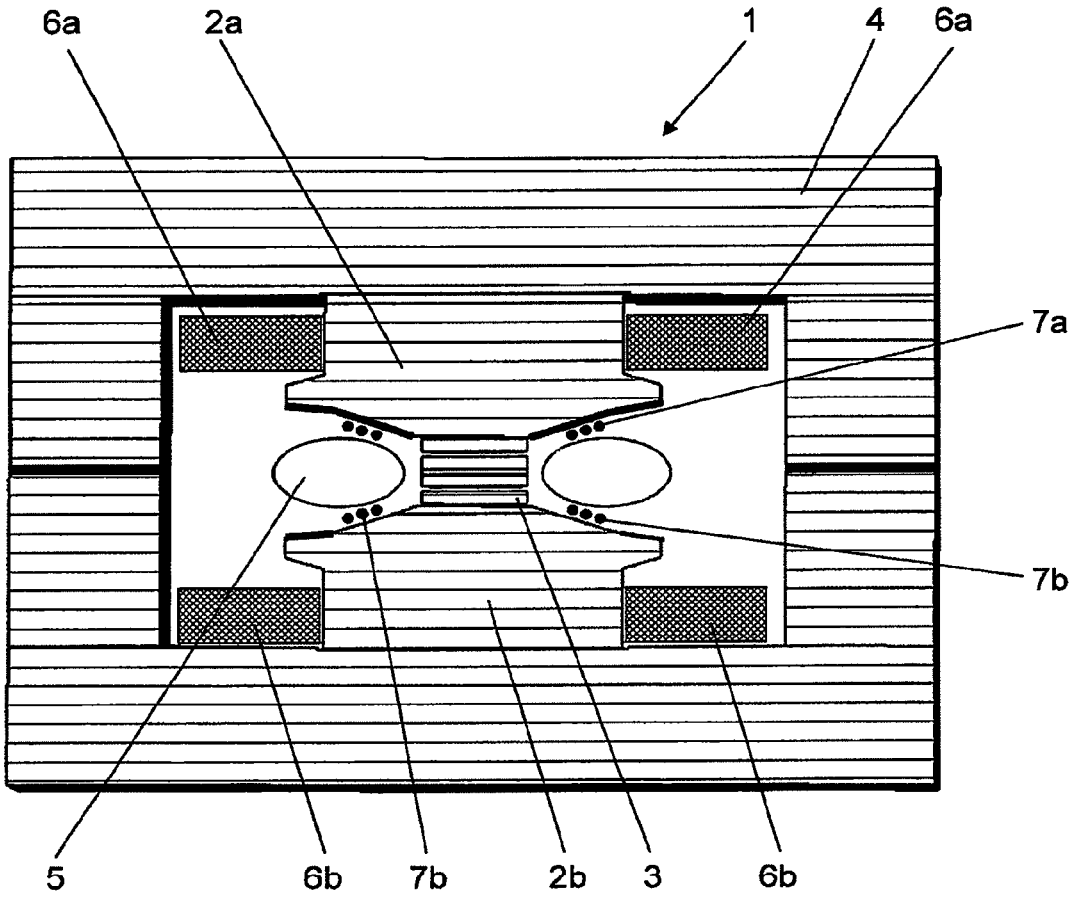
FIG. 1 shows a schematic sectional view through a betatron of the invention.

FIG. 1 shows the schematic structure of a preferred betatron 1 in cross section. It includes, inter alia, a rotationally symmetric inner yoke of two spaced-apart parts 2*a*, 2*b*, four optional round plates 3 between inner yoke parts 2*a*, 2*b*, whereby the longitudinal axis of round plates 3 corresponds to the rotational symmetry axis of the inner yoke, an outer yoke 4 connecting the two inner yoke parts 2*a*, 2*b*, a torus-shaped betatron tube 5 arranged between inner yoke parts 2*a*, 2*b*, two main field coils 6*a* and 6*b*, and control electronics 8, which are not shown in FIG. 1. Main field coils 6*a* and 6*b* are arranged on shoulders of inner yoke parts 2*a* or 2*b*. The magnetic field produced by them penetrates the inner yoke parts 2*a* and 2*b* and the region between their opposite front sides, whereby the magnetic circuit is closed by outer yoke 4. The shape of the inner and/or outer yoke can be selected by the person skilled in the art depending on the application and can deviate from the shape shown in FIG. 1. Only one or more than two main field coils may also be present. A different number and/or shape of the round plates are likewise possible.

Between the front sides of inner yoke parts 2*a* and 2*b*, the magnetic field runs partially through round plates 3 and otherwise through an air gap. Betatron tube 5 is arranged in said air gap. This is an evacuated tube in which the electrons are accelerated. The front sides of inner yoke parts 2*a* and 2*b* have a shape that is selected so that the magnetic field between them focuses the electrons in an orbit. The design of the front sides is known to the person skilled in the art and is therefore not explained in greater detail. At the end of the acceleration process, the electrons hit a target and thereby produce x-radiation whose spectrum depends, inter alia, on the final energy of the electrons and the material of the target.

For acceleration, the electrons are injected with an initial energy into betatron tube 5. During the acceleration phase, the magnetic field in betatron 1 is continuously increased by main field coils 6*a* and 6*b*. As a result, an electric field is produced that exerts an accelerating force on the electrons. At the same time, due to the Lorentz force, the electrons are forced into a nominal orbit within betatron tube 5.

The acceleration of the electrons is repeated periodically, which results in a pulsed x-radiation. In each period, in a first step the electrons are injected into betatron tube 5. In a second step, the electrons are accelerated by an increasing current in main field coils 6*a* and 6*b* and thereby an increasing magnetic field in the air gap between inner yoke parts 2*a* and 2*b* in the circumferential direction of its orbit. In a third step, the accelerated electrons are deflected onto the target to produce x-radiation. Then an optional pause follows before electrons are again injected into betatron tube 5.

The aforementioned Wideroe condition applies to the path of the electrons in betatron tube 5, which results from the fact that the centripetal force offsets the Lorentz force. The radius $r_s$, which fulfills the equation $$\frac{1}{2}\frac{d}{dt}\langle B(r_s)\rangle = \frac{d}{dt}B(r_s)$$

is the stable nominal orbit radius in which the electrons circulate.

The electron gun emits the electrons with a known opening angle, whereby the distribution of the electrons over this opening angle typically is not constant. In addition, the electron gun injects the electrons onto an injection radius $r_1$ differing from the nominal orbit radius $r_s$. It is therefore necessary first to transfer the electrons from the injection radius $r_1$ to the nominal orbit radius $r_s$. The two contraction and expansion coils 7*a* and 7*b*, which are arranged between the front sides of inner yoke parts 2*a* or 2*b* and betatron tube 5 are used to this end. The CE coils are indicated in FIG. 1 by three spiral windings, whereby, however, any other design is possible. The radius of CE coils 7*a* and 7*b* is substantially the same as the nominal orbit radius $r_s$ of the electrons in betatron tube 5. Owing to the spatial expansion of CE coils 7*a* and 7*b*, their outer edges extend slightly beyond the nominal orbit radius $r_s$. The precise size and positioning of the CE coils is left to the person skilled in the art practicing the invention. The condition must be maintained, however, that the inner radius of CE coils 7*a* and 7*b* is greater than the outer radius of round plates 3, so that the magnetic field produced by them also penetrates parts of the region outside round plates 3.

The central axes of CE coils 7*a* and 7*b* coincide with the rotational symmetry axis of the inner yoke. Because of this arrangement and the size of CE coils 7*a* and 7*b*, the magnetic field produced by them penetrates a circular area whose radius is greater than the radius of round plates 3 and lies approximately within the range of the nominal orbit radius $r_s$.

Figure 2:
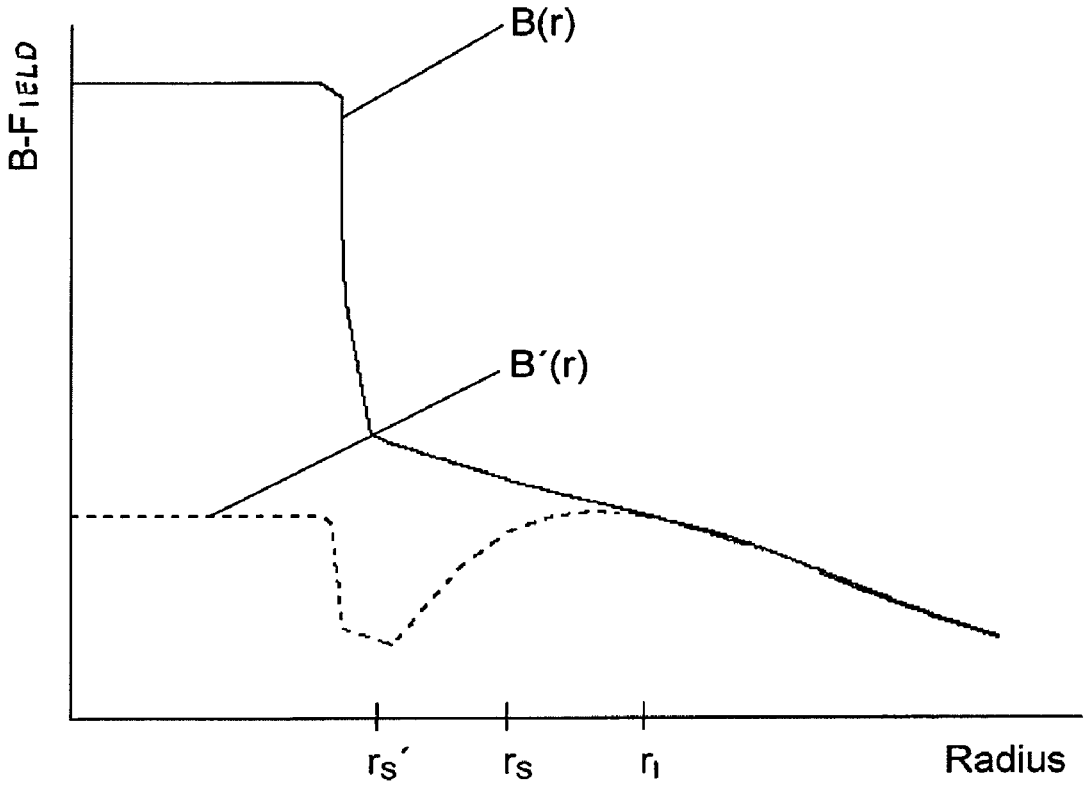
FIG. 2 shows a qualitative course of the magnetic field strength versus the radius during the injection phase.

FIG. 2 shows qualitatively the course of magnetic field B, shown as a solid line, versus the radius, proceeding from the rotational symmetry axis of the inner yoke, and the injection radius $r_1$ of the electrons. Based on the magnetically active material of round plates 3, an almost constant magnetic field results within round plates 3. The magnetic field is considerably lower in the air outside the round plates and moreover declines with an increasing radius. In the depicted magnetic field, the nominal orbit radius $r_s$ drawn in FIG. 2 fulfills the Wideroe condition.

If a current, the so-called contraction pulse, is impressed in CE coils 7*a* and 7*b*, the course B'(r) of the magnetic field strength versus the radius, as drawn as a broken line in FIG. 2, results qualitatively as a superposition of the magnetic fields of main field coils 6*a*, 6*b* and CE coils 7*a*, 7*b*. In the case of this resulting magnetic field, the changed nominal orbit radius $r_s'$fulfills the Wideroe condition. It follows that the electrons are drawn into a spiral path from the injection radius $r_1$ to the changed nominal orbit radius $r_s'$. In this case, the electrons, for example, depending on their injection angle into betatron tube 5, pass the desired nominal orbit radius $r_s$ at different time points. The electrons at the end of the contraction pulse or in the vicinity of the desired nominal orbit radius $r_s$ are then accelerated to this radius.

The part of the electron gun opening angle from where the electrons that are accelerated to the desired final energy originate can thereby be selected by selection of the end time point of the contraction pulse.

Therefore, the intensity of the x-radiation produced by betatron 1 can be maximized and controlled.

Figure 3:
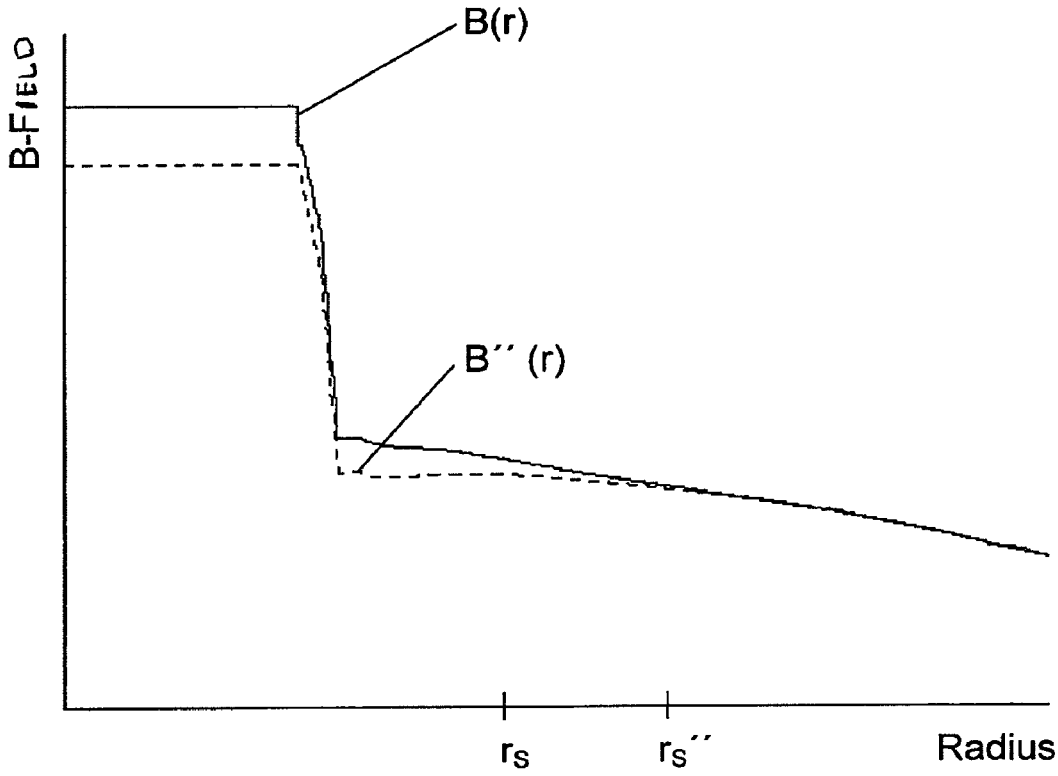
FIG. 3 shows a qualitative course of the magnetic field strength versus the radius during the deflection phase.

At the end of the acceleration process, main field coils 6*a* and 6*b* produce the magnetic field B(r), which is shown qualitatively in FIG. 3 as a solid line and whose course corresponds substantially to the magnetic field of FIG. 2. Because of the higher current through main field coils 6*a* and 6*b*, the magnetic field is much greater, however. In addition, the material of the yoke and/or the round plates is in a nonlinear region of the hysteresis curve. When CE coils 7*a* and 7*b* are supplied with the so-called expansion pulse, accordingly the superposed magnetic field B" (r), shown as a broken line in FIG. 3, is obtained. Proceeding from this superposed magnetic field, the changed nominal orbit radius $r_s''$ fulfills the Wideroe condition. It follows that the electrons drift on a spiral path from nominal orbit radius $r_s$ valid during the acceleration in the direction of the changed nominal orbit radius $r_s''$. During this drifting motion, the electrons impact the target and thereby produce x-radiation.

An x-ray detector, not drawn in the figures, detects the intensity of the produced x-radiation and routinely transfers information on the intensity to control electronics 8. The electronics evaluate the intensity and determine therefrom the duration and the time points of the contraction and expansion pulse for the next periods of electron acceleration.

Figure 4:
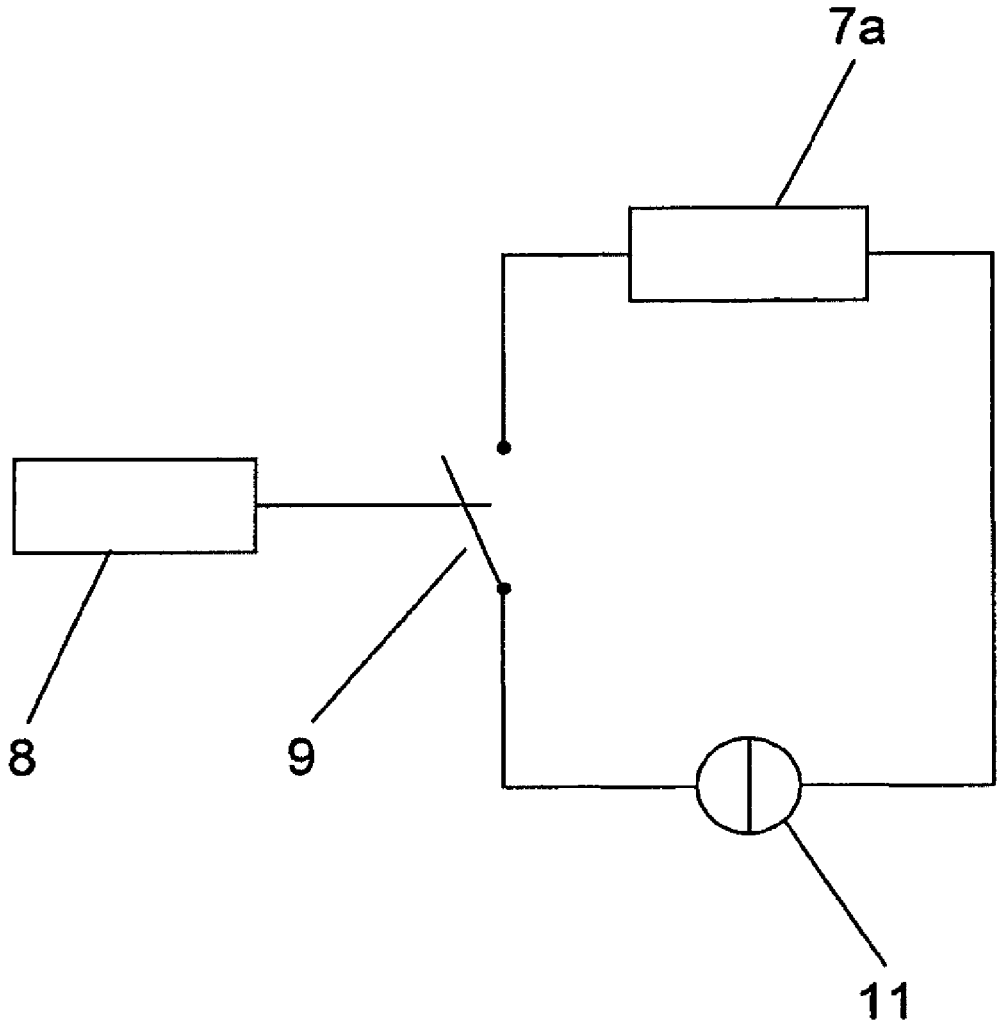
FIG. 4 shows an electric circuit to control a CE coil.
Figure 5:
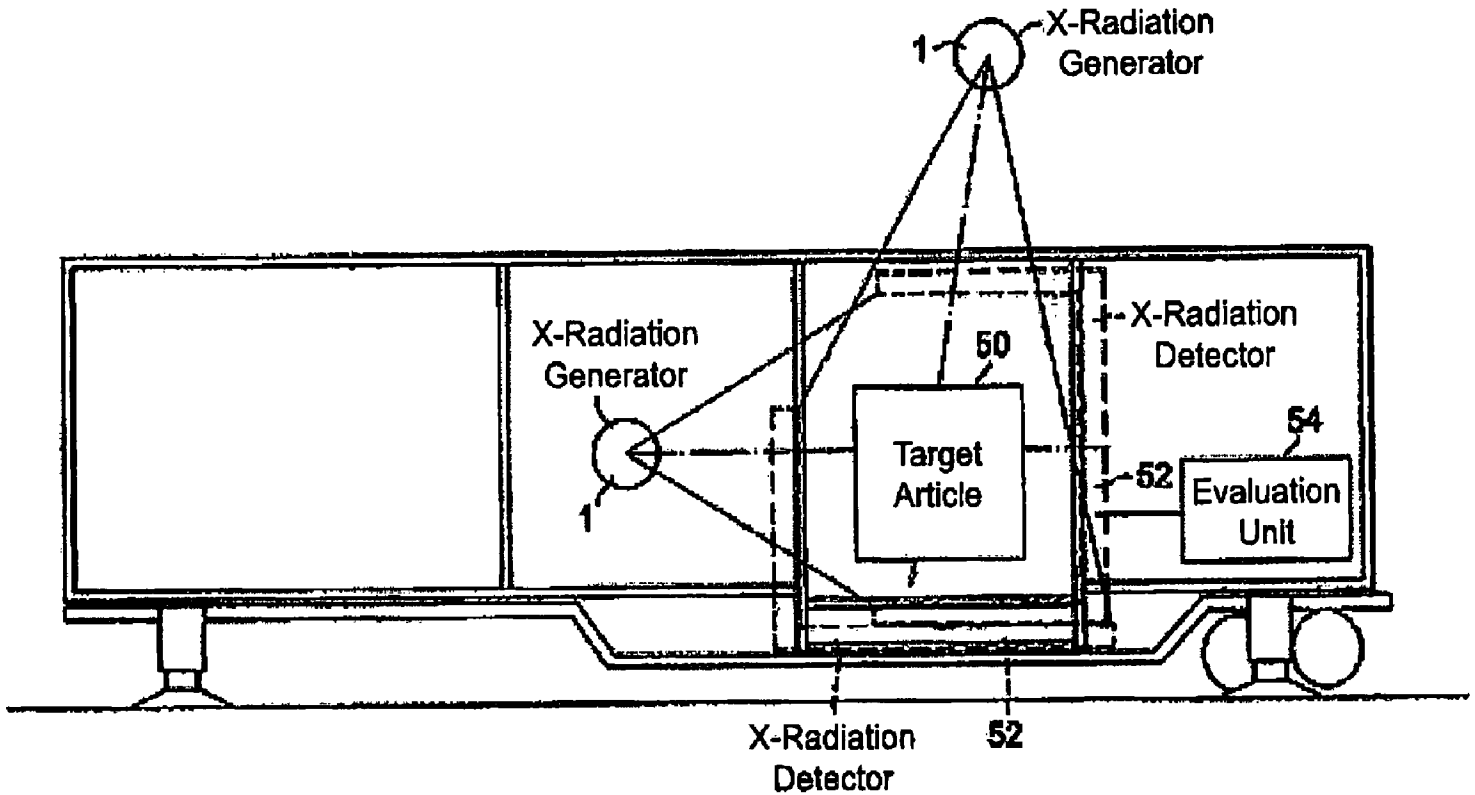
Fig. 5 (Conventional Art)
FIG. 5 shows a conventional x-ray inspection system for security inspection of objects.

FIG. 4 shows by way of example an electric circuit for supplying current to CE coil 7*a*, which can be applied identically to CE coil 7*b*. CE coil 7*a* is connected via a switch 9 controllable by control electronics 8 to a voltage source 11. Optionally, several CE coils are connected via one or more switches to a common voltage source. Furthermore, alternatively, each CE coil is connected via a separate switch to a voltage source assigned to the CE coil.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A betatron for an x-ray inspection system, the betatron comprising:

a rotationally symmetric inner yoke having two spaced-apart parts;

an outer yoke connecting the two inner yoke parts;

at least one main field coil;

a torus-shaped betatron tube arranged between opposing front sides of the inner yoke parts; and at least one contraction and expansion coil, whereby in each case precisely one contraction and expansion coil is arranged between a front side of an inner yoke part and the betatron tube, wherein the radius of the contraction and expansion coil is substantially the same as the nominal orbit radius of the electrons in the betatron tube, and wherein each contraction and expansion coil is configured to perform both contraction and expansion of the electron orbit radius.

2. The betatron according to claim 1, wherein the same contraction and expansion coil is configured to both focus the electrons on the nominal orbit during an injection phase and to deflect the electrons onto a target during a deflection phase.

3. The betatron according to claim 1, wherein the opposing front sides of the inner yoke parts are formed and arranged with mirror symmetry to one another.

4. The betatron according to claim 1, wherein at least one main field coil is arranged on the inner yoke or on a neck or a shoulder of the inner yoke.

5. The betatron according to claim 4, further comprising two main field coils, wherein a main field coil is arranged on each of the inner yoke parts.

6. The betatron according to claim 1, wherein at least one round plate is arranged between the inner yoke parts, and wherein the round plate is arranged so that its longitudinal axis substantially coincides with the rotational symmetry axis of the inner yoke.

7. The betatron according to claim 1, wherein the connections of at least one of the contraction and expansion coils are connected to a current or voltage source and wherein, in at least one line, a switch actuatable by control electronics is arranged between the contraction and expansion coil and the current or voltage source.

8. The betatron according to claim 7, wherein the control electronics are configured such that the turn-on time and the turn-on duration of the switch are variable.

9. The betatron according to claim 8, further comprising a detector to determine the radiation intensity generated by the betatron.

10. The betatron according to claim 9, wherein the detector is connected to the control electronics and the turn-on time and the turn-on duration of the switch is determined by the control electronics from an output signal of the detector.

11. An x-ray inspection system for security inspection of objects, comprising:

a target to produce x-radiation;

an x-ray detector;

an evaluation unit; and a betatron, the betatron comprising:

a rotationally symmetric inner yoke having two spaced-apart parts;

an outer yoke connecting the two inner yoke parts;

at least one main field coil;

a torus-shaped betatron tube arranged between opposing front sides of the inner yoke parts; and at least one contraction and expansion coil, whereby in each case precisely one contraction and expansion coil is arranged between a front side of an inner yoke part and the betatron tube, wherein the radius of the contraction and expansion coil is substantially the same as the nominal orbit radius of the electrons in the betatron tube, and wherein each contraction and expansion coil is configured to perform both contraction and expansion of the electron orbit radius.

12. The betatron according to claim 7, wherein the switch is an IGBT (insulated gate bipolar transistor).

* * * * *